US010544606B2

(12) United States Patent
Sasadate et al.

(10) Patent No.: US 10,544,606 B2
(45) Date of Patent: Jan. 28, 2020

(54) DOOR LOCK CONTROL SYSTEM AND DOOR LOCK APPARATUS

(71) Applicants: KABUSHIKI KAISHA TOSHIBA, Tokyo (JP); TOSHIBA ELECTRONIC DEVICES & STORAGE CORPORATION, Tokyo (JP)

(72) Inventors: Kai Sasadate, Kanagawa (JP); Masaki Jono, Kanagawa (JP); Hiroaki Sugita, Tokyo (JP); Tetsuro Oishi, Kanagawa (JP); Minoru Yagi, Kanagawa (JP)

(73) Assignees: KABUSHIKI KAISHA TOSHIBA, Tokyo (JP); TOSHIBA ELECTRONIC DEVICES & STORAGE CORPORATION, Tokyo (JP)

( * ) Notice: Subject to any disclaimer, the term of this patent is extended or adjusted under 35 U.S.C. 154(b) by 0 days.

(21) Appl. No.: 16/120,074

(22) Filed: Aug. 31, 2018

(65) Prior Publication Data

US 2019/0277066 A1 Sep. 12, 2019

(30) Foreign Application Priority Data

Mar. 9, 2018 (JP) ..... 2018-042822

(51) Int. Cl.
*E05B 77/48* (2014.01)
*G07C 9/00* (2006.01)

(52) U.S. Cl.
CPC ..... *E05B 77/48* (2013.01); *G07C 9/00182* (2013.01); *G07C 9/00817* (2013.01);
(Continued)

(58) Field of Classification Search
None
See application file for complete search history.

(56) References Cited

U.S. PATENT DOCUMENTS

2011/0148569 A1* 6/2011 Froitzheim ..... B60R 25/24 340/5.7
2015/0248801 A1* 9/2015 Froitzheim ..... B60R 25/245 340/5.61

(Continued)

FOREIGN PATENT DOCUMENTS

JP 5542982 B2 7/2014
JP 2016-035133 A 3/2016

(Continued)

*Primary Examiner* — Daniell L Negron
(74) *Attorney, Agent, or Firm* — Kim & Stewart LLP

(57) ABSTRACT

A door lock control system includes a first device including a first transmitter, a first receiver, and a first controller configured to measure first signal strengths of radio signals received from a plurality of surrounding devices by the first receiver, and control the first transmitter to transmit the measured first signal strengths to a second device. The system further includes the second device including a second receiver and a second controller configured to measure second signal strengths of radio signals received from a plurality of surrounding devices by the second receiver, control the second receiver to receive the first signal strengths from the first device, compare the first signal strengths with the second signal strengths, and control a door lock based on the comparison of the first and the second signal strengths.

18 Claims, 7 Drawing Sheets

(52) U.S. Cl.
CPC ..... *G07C 2009/00206* (2013.01); *G07C 2009/00769* (2013.01); *G07C 2009/00825* (2013.01); *G07C 2009/00841* (2013.01); *G07C 2209/64* (2013.01)

(56) References Cited

U.S. PATENT DOCUMENTS

| | | | | |
|---|---|---|---|---|
| 2016/0267734 | A1* | 9/2016 | Hamada | G07C 9/00309 |
| 2016/0350992 | A1* | 12/2016 | Telljohann | H04W 4/70 |
| 2017/0200334 | A1* | 7/2017 | Buttolo | B60R 16/023 |

FOREIGN PATENT DOCUMENTS

| | | | |
|---|---|---|---|
| JP | 2016-211334 | A | 12/2016 |
| JP | 6090580 | B2 | 3/2017 |
| JP | 2017-125354 | A | 7/2017 |

* cited by examiner

DOOR LOCK CONTROL SYSTEM AND DOOR LOCK APPARATUS

CROSS-REFERENCE TO RELATED APPLICATIONS

This application is based upon and claims the benefit of priority from Japanese Patent Application No. 2018-042822, filed Mar. 9, 2018, the entire contents of which are incorporated herein by reference.

FIELD

Embodiments described herein relate generally to a door lock control system and a door lock apparatus.

BACKGROUND

A door lock control system is known in which an in-vehicle device mounted on a moving unit such as a car locks and unlocks a door by authenticating a specific electronic key possessed by a user. As the door lock control system, there is a system in which a mutual distance from the in-vehicle device to the electronic key is determined based on radio wave intensity of a response signal from the electronic key and the door can be locked and unlocked in a case where the mutual distance is equal to or less than a predetermined distance.

However, in this door lock control system, even if a radio wave is emitted from a point more distant than a predetermined distance, when the radio wave is re-transmitted via a relay device or the like, there is a possibility that the door is erroneously locked and unlocked.

DETAILED DESCRIPTION

Embodiments provide a door lock control system and a door lock apparatus that can perform door lock control more accurately according to a distance between devices.

In general, according to an embodiment, a door lock control system comprises a first device comprising a first transmitter, a first receiver, and a first controller configured to measure first signal strengths of radio signals received from a plurality of surrounding devices by the first receiver, and control the first transmitter to transmit the measured first signal strengths to a second device, and the second device including a second receiver, and a second controller configured to measure second signal strengths of radio signals received from a plurality of surrounding devices by the second receiver, control the second receiver to receive the first signal strengths from the first device, compare the first signal strengths with the second signal strengths, and control a door lock based on the comparison of the first and the second signal strengths.

Hereinafter, embodiments of the present disclosure will be described with reference to the drawings.

One Embodiment

Figure 1:
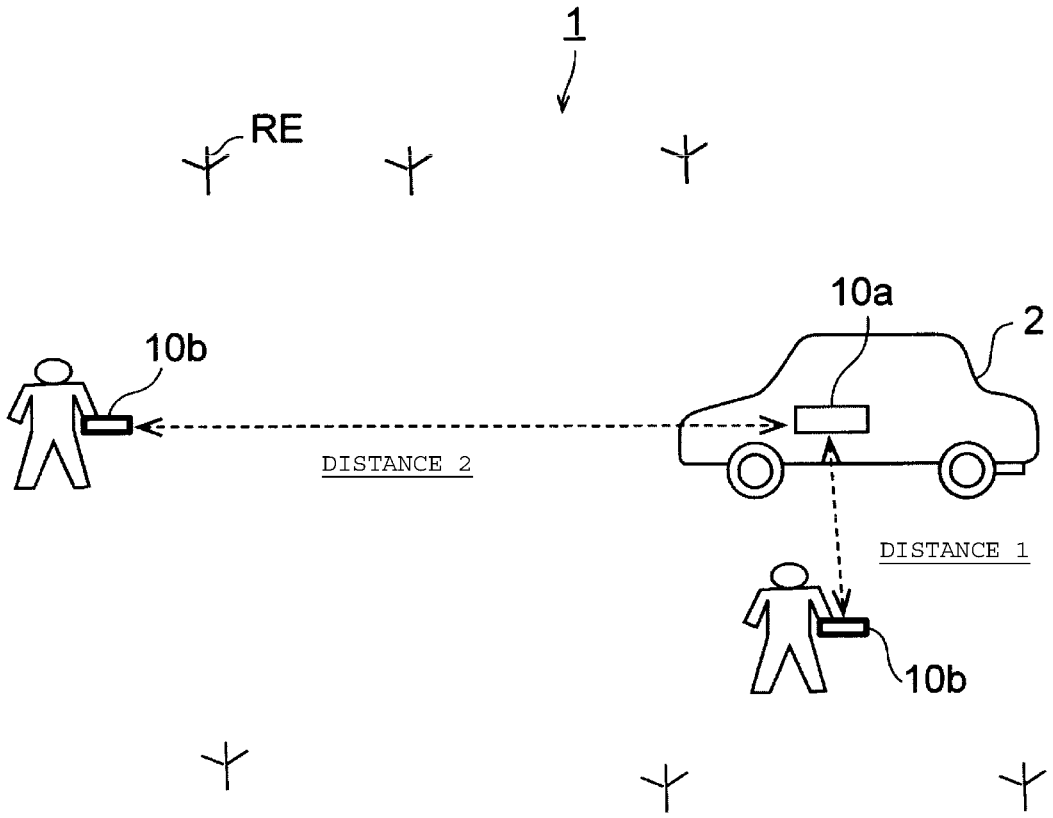
FIG. 1 is a diagram for explaining an arrangement example of a door lock control system.

FIG. 1 is a diagram for explaining an arrangement example of a door lock control system 1 according to an embodiment. As illustrated in FIG. 1, the door lock control system 1 according to the present embodiment includes an in-vehicle device 10*a* and an electronic key 10*b* capable of performing wireless communication with each other. In FIG. 1, in addition to the door lock control system 1, a car 2 as, for example, a moving unit on which the in-vehicle device 10*a* is mounted and a plurality of devices RE performing short range communication are illustrated. The plurality of short range communication devices RE are low energy devices such as Bluetooth (registered trademark) device, for example. Here, the in-vehicle device 10*a* may be another moving unit such as a train, an airplane, or the like. The electronic key 10*b* is also one of the devices that can perform communication at a short distance, similar to the short range communication device RE.

The in-vehicle device 10*a* can measure a radio wave condition of the electronic key 10*b* held by a user and the plurality of short range communication devices RE in the vicinity of the in-vehicle device 10*a* within a measurable range. With this, whether to lock or unlock the door of the car 2 is controlled, according to similarity between radio wave conditions of the plurality of devices RE measured by the in-vehicle device 10*a* and the radio wave condition of the plurality of devices RE measured by the electronic key 10*b*. A detailed configuration of the in-vehicle device 10*a* will be described later.

The electronic key 10*b* is a device having a function of measuring radio wave conditions of the plurality of devices RE. The electronic key 10*b* is, for example, a device carried by a driver (user) of the car 2 as the moving unit, and the radio wave conditions of the plurality of devices RE measured by the electronic key 10*b* change according to the distance from the in-vehicle device 10*a* of the car 2. For example, the radio wave conditions of a plurality of devices RE measured by the electronic key 10*b* at Distance 1 is different from the radio wave conditions of the plurality of devices RE measured by the electronic key 10*b* at Distance 2. Distance 1 is, for example, 1 meter and Distance 2 is, for example, 20 meters.

Figure 2:
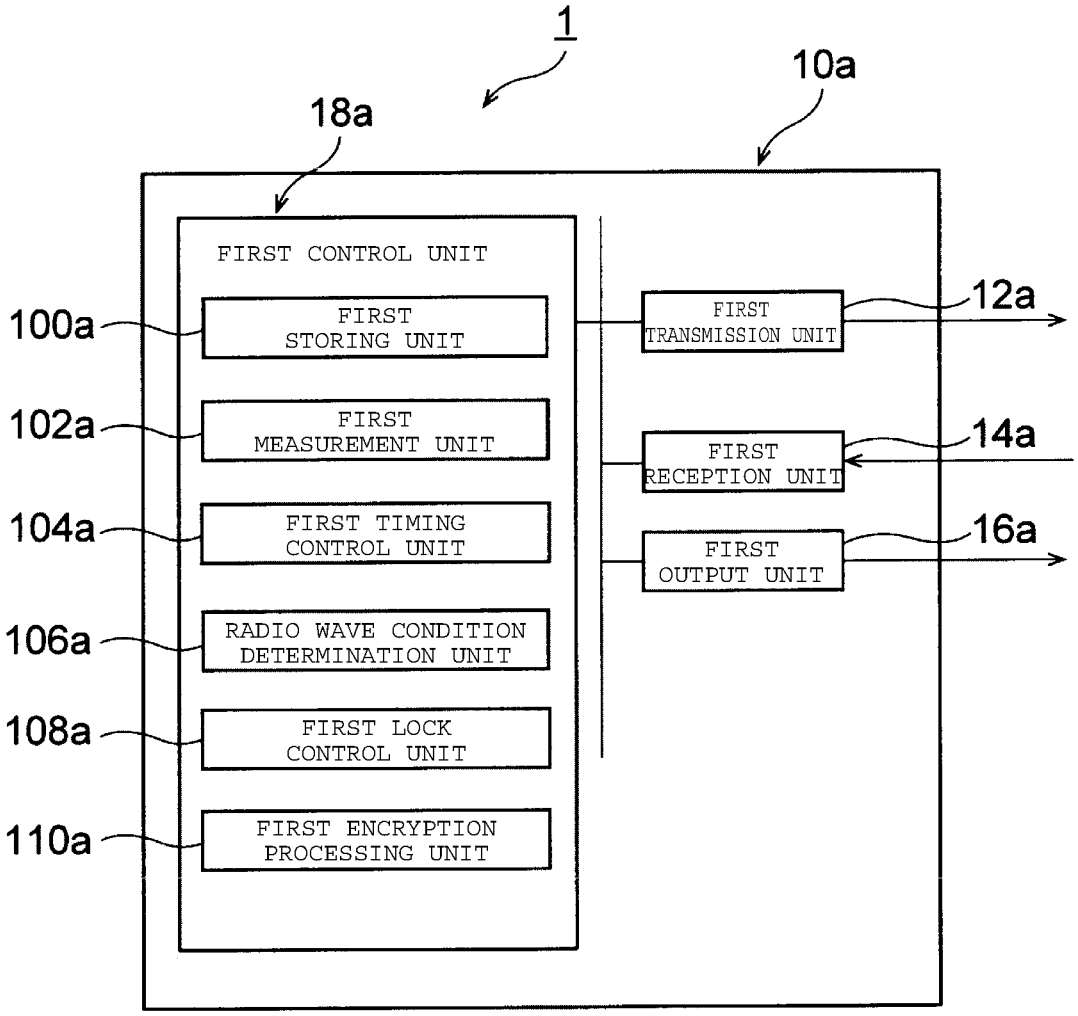
FIG. 2 is a block diagram illustrating a configuration of an in-vehicle device.
Figure 3:
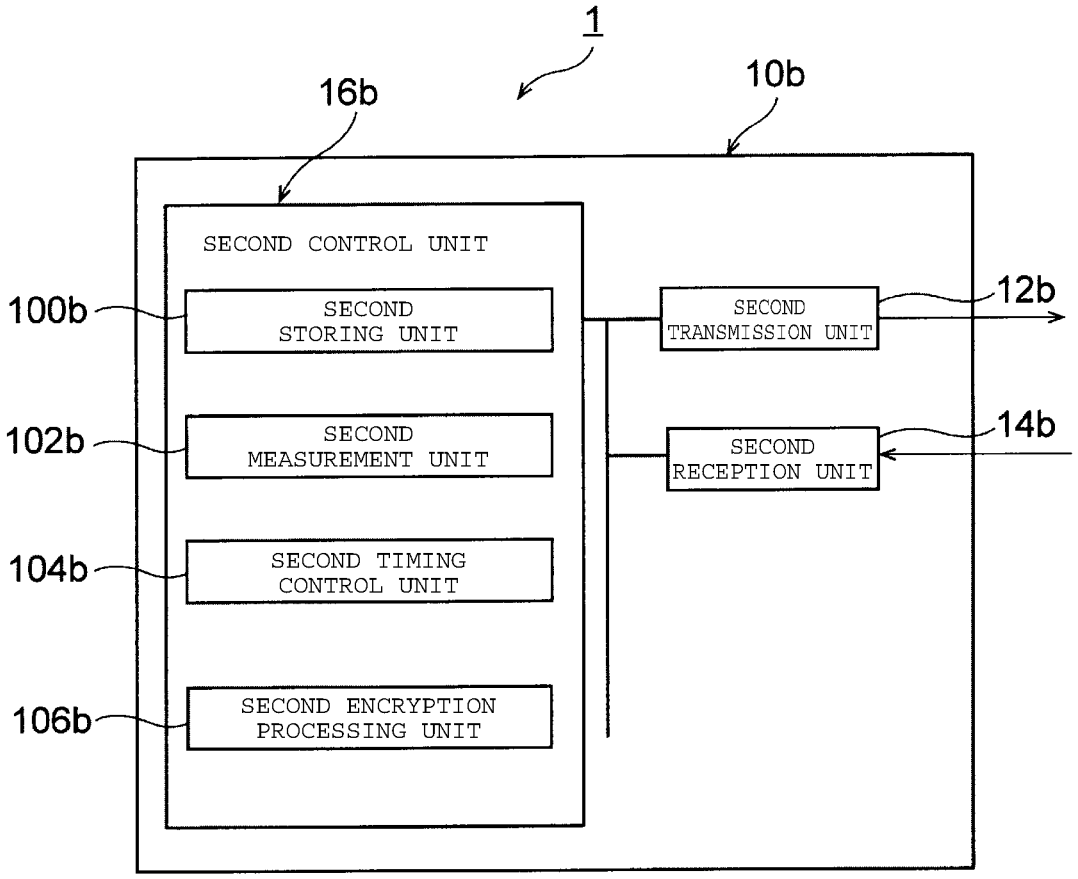
FIG. 3 is a block diagram illustrating a configuration of an electronic key.

Here, a detailed configuration of the in-vehicle device 10*a* and the electronic key 10*b* will be described with reference to FIGS. 2 and 3. FIG. 2 is a block diagram illustrating a detailed configuration of the in-vehicle device 10*a* of the door lock control system 1 according to the present embodiment. FIG. 3 is a block diagram illustrating a detailed configuration of the electronic key 10*b* of the door lock control system 1 according to the present embodiment. The "a" is attached to the configuration related to the in-vehicle device 10*a*, and "b" is attached to the configuration related to the electronic key 10*b* to distinguish the configurations.

As illustrated in FIG. 2, the in-vehicle device 10*a* is a device capable of wireless communication with the electronic key 10*b*, and includes a first transmission unit 12*a* (e.g., a transmitter circuit), a first reception unit 14*a* (e.g., a receiver circuit), a first output unit 16*a*, and a first control unit 18*a* (e.g., a controller circuit). The first control unit 18*a* includes a first storing unit 100*a*, a first measurement unit 102*a*, a first timing control unit 104*a*, a radio wave condition determination unit 106*a*, a first lock control unit 108*a*, and a first encryption processing unit 110*a*.

As illustrated in FIG. 3, the electronic key 10*b* includes a second transmission unit 12*b* (e.g., a transmitter circuit), a second reception unit 14*b* (e.g., a receiver circuit), and a second control unit 16*b* (e.g., a controller circuit). The second control unit 16*b* includes a second storing unit 100*b*, a second measurement unit 102*b*, a second timing control unit 104*b*, and a second encryption processing unit 106*b*.

As illustrated in FIG. 1 and FIG. 2, the first transmission unit 12*a* of device 10*a* includes an antenna which is attached to, for example, a roof portion of the car 2. The first transmission unit 12*a* transmits a response request signal or the like to the outside the car or into the car using a radio wave having a long wavelength of 125 KHz or the like.

The first receiver 14*a* includes an antenna and is attached to, for example, the roof portion of the car 2. The first reception unit 14*a* receives a response signal or the like transmitted using radio waves of a high frequency band, for example, 315 MHz and the like from the electronic key 10*b*.

The first output unit 16*a* outputs a lock signal or an unlock signal to a lock mechanism of the car 2. The lock signal is a signal for locking the door and the unlock signal is a signal for unlocking the door.

The first control unit 18*a* comprises a processor that reads a program from the first storing unit 100*a* and executes the program so as to implement a processing unit corresponding to each program. Here, the term "processor" means a circuit, for example, a central processing unit (CPU).

The first storing unit 100*a* is implemented by a semiconductor memory device such as a random access memory (RAM), a flash memory, a hard disk, or the like. The first storing unit 100*a* stores programs to be executed by the first control unit 18*a* and various control data.

The first measurement unit 102*a* measures a radio wave condition. The first measurement unit 102*a* measures radio wave intensity from a predetermined device to be measured from the position of the first measurement unit 102*a* as the radio wave condition. For example, the first measurement unit 102*a* measures radio wave intensity of radio waves emitted from a device performing short range communication, for example, Bluetooth (registered trademark) low energy device.

Figure 4:
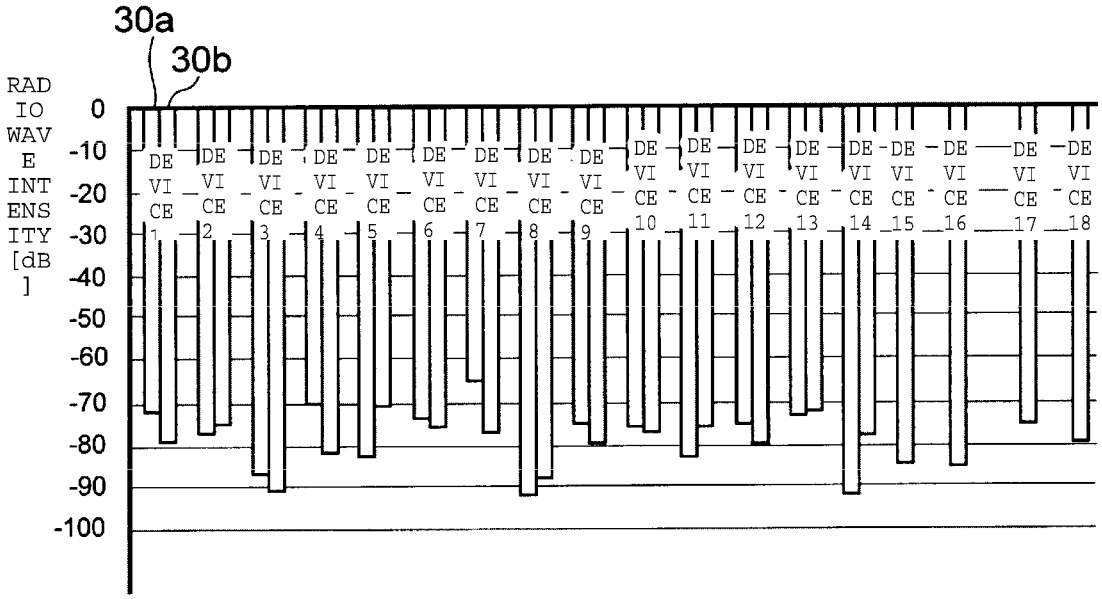
FIG. 4 is a diagram illustrating radio wave condition in a case where the distance between the in-vehicle device and the electronic key is 1 meter.

FIG. 4 is a diagram illustrating radio wave conditions in a case where the distance between the in-vehicle device 10*a* and the electronic key 10*b* is 1 meter. The horizontal axis represents each device emitting radio waves, and the vertical axis represents radio wave intensity. A left side bar 30*a* of each pair of a pair of bars for each device corresponds to radio waves measured by the first measurement unit 102*a* of the in-vehicle device 10*a* and a bar 30*b* on the right side of each pair corresponds to radio waves measured by the second measurement unit 102*b* of the electronic key 10*b* described later, for each respective device. The first measurement unit 102*a* acquires the radio wave conditions of sixteen devices among Device 1 to Device 18. Measured signal intensities of fourteen devices (Device 1 to Device 14) of the sixteen devices match that of the devices measured by the second measurement unit 102*b*. As can be seen from the figure, when the in-vehicle device 10*a* and the electronic key 10*b* are close to each other, for example, within 5 meters, the similarity between radio wave conditions acquired by the in-vehicle device 10*a* (left side bars) and the electronic key 10*b* (right side bars for each device) is high.

Figure 5:
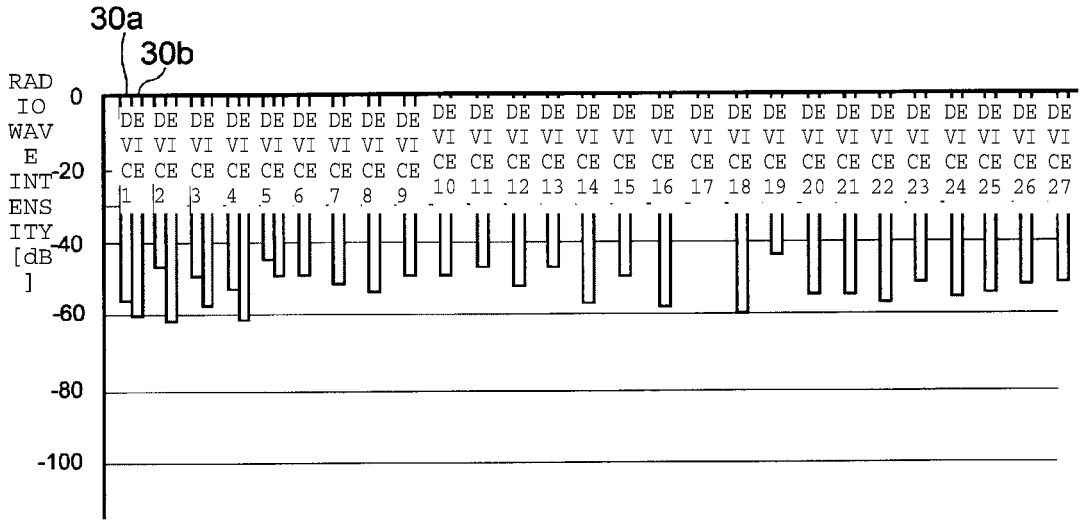
FIG. 5 is a diagram illustrating radio wave condition in a case where the distance between the in-vehicle device and the electronic key is 20 meters.

FIG. 5 is a diagram illustrating radio wave conditions in a case where the distance between the in-vehicle device 10*a* and the electronic key 10*b* is 20 meters. Pairs of bars along the horizontal axis represent signals from each device emitting radio waves, and the vertical axis represents radio wave intensity for those signals. The bar 30*a* on the left side of each pair corresponds to radio waves measured by the first measurement unit 102*a* of the in-vehicle device 10*a* and the bar 30*b* on the right side of each pair corresponds to radio waves measured by the second measurement unit 102*b* of the electronic key 10*b*. The first measurement unit 102*a* acquires the radio wave conditions of sixteen devices among Device 1 to Device 27, and regarding the radio wave conditions, five devices of sixteen devices (Device 1 to Device 5) match the devices measured by the second measurement unit 102*b*. As can be seen from the figure, when the distance between the in-vehicle device 10*a* and the electronic key 10*b* is, for example, more than ten meters or more, the similarity between the radio wave conditions acquired by the in-vehicle device 10*a* and the electronic key 10*b* is low.

As illustrated in FIG. 2, the first timing control unit 104*a* synchronizes the timing at which the electronic key 10*b* measures the radio wave condition and the timing at which measurement by the first measurement unit 102*a* is performed. More specifically, the first timing control unit 104*a* transmits a measurement start signal including information on the time for performing one or more measurements to the electronic key 10*b* by the first transmission unit 12*a*.

The radio wave condition determination unit 106*a* compares the radio wave condition measured by the first measurement unit 102*a* with the radio wave condition transmitted from the electronic key 10*b* and determines whether or not the similarity is high. For example, the radio wave condition determination unit 106*a*, determines whether or not the similarity is high according to the number of matching devices that output predetermined radio wave intensity by using the information on the radio wave condition measured by the first measurement unit 102*a* and the information on the radio wave condition transmitted from the electronic key 10*b*.

The radio wave condition determination unit 106*a* may determine whether the similarity is high according to a matching ratio of the devices that output the predetermined radio wave intensity. As illustrated in FIG. 4, for example, in a case where two thirds or more devices, among the devices (Device 1 to Device 18) whose radio wave intensities measured by the first measurement unit 102*a* are equal to or greater than a predetermined value, match devices (Device 1 to Device 14) measured by the second measurement unit 102*b* of the electronic key 10*b*, it is determined that the similarity is high. On the other hand, as illustrated in FIG. 5, in a case where the matching devices (Device 1 to Device 5) among the devices (Device 1 to Device 27) whose radio wave intensities measured by the first measurement unit 102*a* are equal to or greater than a predetermined value are, for example, less than two thirds of the devices, it is determined that the similarity is low. As such, the radio wave condition determination unit 106*a* determines whether or not the similarity is high according to the number of matching devices that output the predetermined radio wave intensity, using the mutual radio wave condition information. In the meantime, a criterion for determining the similarity between the radio wave conditions is not necessary to be limited to the matters described above, and it is possible to set the similarity criterion according to the environment in which this system is placed, such as transmission radio wave intensity and reception sensitivity of the in-vehicle device 10*a*, the electronic key 10*b*, and the short range communication device RE, the distance between the devices, and the like.

The first lock control unit 108*a* controls whether to lock or unlock according to the similarity between the radio wave condition measured by the first measurement unit 102*a* and the radio wave condition transmitted from the electronic key 10*b*. That is, the first lock control unit 108*a* controls whether to lock or unlock the door of the car 2, based on the determination of the radio wave condition determination unit 106*a*. For example, the first lock control unit 108*a* outputs an unlock signal to the lock mechanism of the car 2 in a case where the radio wave condition determination unit 106*a* determines that the similarity is high.

On the other hand, in a case where the similarity between the radio wave condition measured by the first measurement unit 102*a* and the radio wave condition transmitted from the electronic key 10*b* is low, the first lock control unit 108*a* outputs a lock signal to the lock mechanism for locking the door to the car 2. For example, the first lock control unit 108*a* outputs the lock signal to the lock mechanism of the car 2 in a case where the radio wave condition determination unit 106*a* determines that the similarity is low.

The first encryption processing unit 110*a* encrypts the first authentication code and decrypts the encrypted second authentication code included in the reception signal. The first encryption processing unit 110*a* performs authentication processing with the electronic key 10*b*. For example, in a case where the decrypted second authentication code matches the second authentication code stored in advance in the first storing unit 100*a*, the first encryption processing unit 110*a* authenticates the electronic key 10*b* as a communication partner.

As illustrated in FIG. 3, the second transmission unit 12*b* includes an antenna and transmits a response signal to the in-vehicle device 10*a* using radio waves of a high frequency band such as 315 MHz, for example. The second reception unit 14*b* includes an antenna and receives, for example, a radio wave having a long wavelength of 125 KHz or the like.

The second control unit 16*b* has a structure equivalent to that of the first control unit 18*a* and comprises a processor that reads a program from the second storing unit 100*b* and executes the program so as to implement a processing unit corresponding to each program. The second storing unit 100*b* is implemented by a semiconductor memory element such as a flash memory or the like. The second storing unit 100*b* stores programs to be executed by the second control unit 16*b* and various control data.

The second measurement unit 102*b* has a structure equivalent to that of the first measurement unit 102*a*, and measures radio wave condition. The second measurement unit 102*b* measures the radio wave intensity from a predetermined device to be measured from the position of the second device 10*b* as the radio wave condition. For example, the second measurement unit 102*b* measures radio wave intensity of the radio wave emitted from the device performing short range communication.

The second timing control unit 104*b* performs control to synchronize the timing of measuring the radio wave condition by the in-vehicle device 10 and the timing of measuring the radio wave condition by the second measurement unit 102*b*. More specifically, the second timing control unit 104*b* causes the second measurement unit 102*b* to measure the radio wave condition, based on a measurement start signal including information on the time at which measurement is performed transmitted from the first timing control unit 104*a*.

The second encryption processing unit 106*b* has the same configuration as the first encryption processing unit 110*a*, and decrypts the first authentication code and encrypts the second authentication code. The second encryption processing unit 106*b* performs authentication processing with the in-vehicle device 10*a*. For example, in a case where the decrypted first authentication code matches the first authentication code stored in advance in the second storing unit 100*b*, the second encryption processing unit 106*b* authenticates the in-vehicle device 10*a* as a communication partner. The in-vehicle device 10*a* according to the present embodiment corresponds to the first device, and the electronic key 10*b* according to the present embodiment corresponds to the second device. Also, the in-vehicle device 10*a* according to the present embodiment corresponds to a door lock apparatus. Furthermore, although the in-vehicle device 10*a* according to the present embodiment, that is, the first device is described as a device mounted on a vehicle, for example, as a moving unit, the present disclosure is not limited to the moving unit. For example, it may be a door lock control device (system) fixed at a predetermined place having a door lock function, for example, like a home delivery post.

Matters as described are the description of the configuration of the door lock control system 1 according to the present embodiment. Next, an operation example of the door lock control system 1 will be described.

Figure 6:
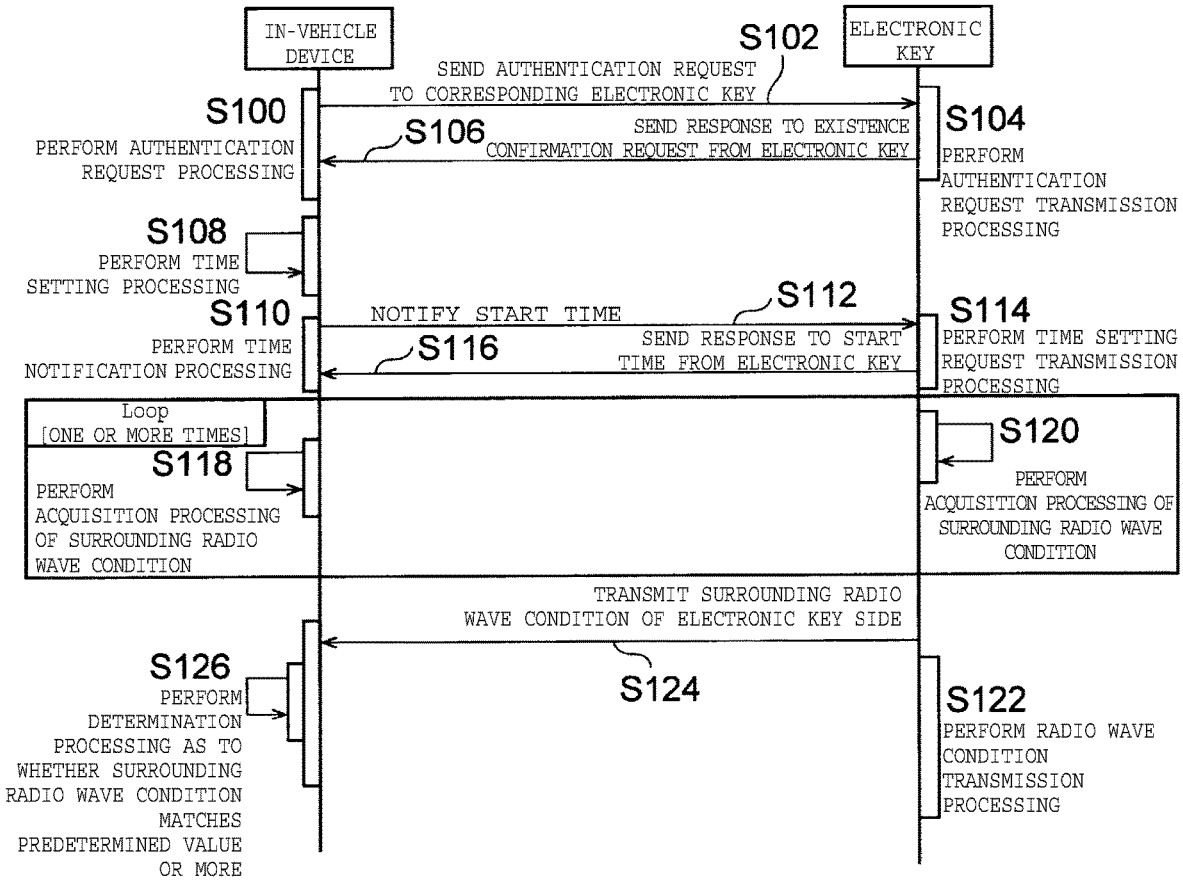
FIG. 6 is a diagram illustrating an operation example of the door lock control system.

FIG. 6 is a diagram for explaining an operation example of the door lock control system 1. As illustrated in FIG. 6, the first encryption processing unit 110*a* of the in-vehicle device 10*a* generates an authentication request signal including the encrypted first authentication code (Step S100). Subsequently, the first encryption processing unit 110*a* outputs the authentication request signal to the electronic key 10*b* (Step S102).

The second encryption processing unit 106*b* of the electronic key 10*b* decrypts the first authentication code included in the authentication request signal and collates the decrypted first authentication code with the first authentication code stored in advance in the second storing unit 100*b* (Step S104). Subsequently, in a case where the first authentication code stored in the second storing unit 100*b* matches the first authentication code included in the authentication request signal, the second encryption processing unit 106*b* transmits a response signal including the encrypted second authentication code to the in-vehicle device 10*a* (Step S106).

Next, the first encryption processing unit 110*a* of the in-vehicle device 10*a* decrypts the encrypted second authentication code included in the response signal, and authenticates the electronic key 10*b* as a communication partner when the decrypted second authentication code matches the second authentication code stored in the first storing unit 100*a*. Subsequently, the first timing control unit 104*a* performs time setting processing for synchronizing the timing of measuring the radio wave condition in the electronic key 10*b* and the timing of measuring by the first measurement unit 102*a* (Step S108). Next, the first timing control unit 104*a* generates a measurement start signal including the measurement start time set by the time setting processing (Step S110), and transmits the measurement start signal to the electronic key 10*b* (Step S112).

Next, the second timing control unit 104*b* of the electronic key 10*b* sets the measurement start time included in the measurement start signal in the second storing unit 100*b* (Step S114) and transmits a response signal including information indicating that the measurement start time is set to the first timing control unit 104*a* of the in-vehicle device 10*a* (Step S116).

Next, the first measurement unit 102*a* of the in-vehicle device 10*a* measures the radio wave intensity of radio waves emitted from the device performing short range communication at the set measurement start time (Step S118). Similarly, the second measurement unit 102*b* of the electronic key 10*b* measures radio wave intensities of radio waves emitted by the device performing short range communication at the set measurement start time (Step S120). Subsequently, the second measurement unit 102*b* generates a radio wave condition signal including information of measured radio wave intensity (Step S122), and transmits the radio wave condition signal to the radio wave condition determination unit 106*a* of the in-vehicle device 10*a* (Step S124).

Next, the radio wave condition determination unit 106*a* compares the radio wave condition measured by the first measurement unit 102*a* with the radio wave condition transmitted from the electronic key 10*b*, and determines whether or not the similarity is high (Step S126).

Figure 7:
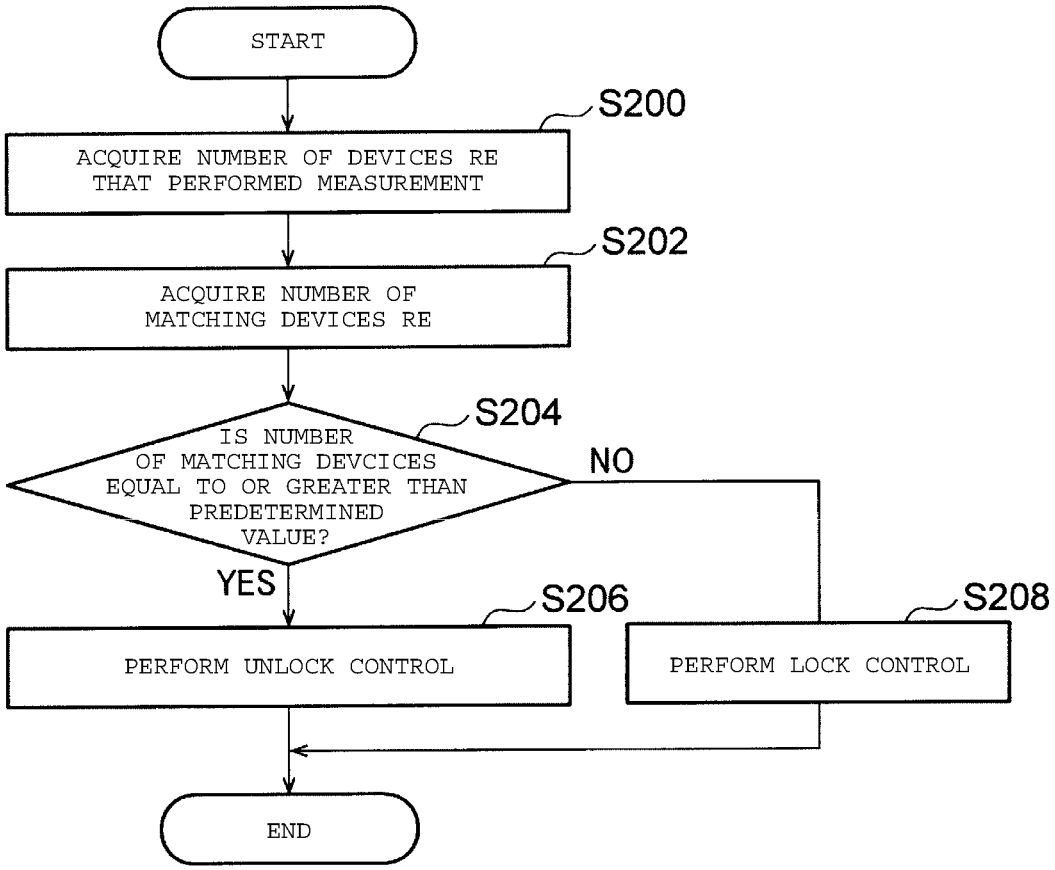
FIG. 7 is a flowchart for explaining determination processing in detail.

FIG. 7 is a flowchart for explaining the determination processing in Step S126 in detail. As illustrated in FIG. 7, the radio wave condition determination unit 106*a* acquires the number of devices of a plurality of devices RE outputting signals with predetermined radio wave intensity, using the information of radio wave conditions measured by the first measurement unit 102*a* (Step S200).

Next, the radio wave condition determination unit 106*a* compares the radio wave condition measured by the first measurement unit 102*a* with the radio wave condition transmitted from the electronic key 10*b* and acquires the number of matching devices between the devices RE detected by the first measurement unit 102*a* and the devices RE detected on the side of the electronic key 10*b* (Step S202). Subsequently, the radio wave condition determination unit 106*a* determines whether a ratio of the number of matching devices to the number of the devices RE detected by the first measurement unit 102*a* is equal to or greater than a predetermined value, for example, two thirds or more (Step S204).

In a case where it is determined that the ratio of the number of matching devices is equal to or greater than the predetermined value, for example, two thirds or more (YES in Step S204), the radio wave condition determination unit 106*a* determines whether the in-vehicle device 10*a* and the electronic key 10 are located within a predetermined distance, for example, within 5 meters. Then, the first lock control unit 108*a* performs unlock control (Step S206). That is, the first lock control unit 108*a* outputs an unlock signal for unlocking the door to the lock mechanism of the car 2.

On the other hand, in a case where it is determined that the ratio of the number of matching devices is less than a predetermined value, for example, two thirds (NO in Step S204), the radio wave condition determination unit 106*a* determines that the in-vehicle device 10*a* and the electronic key 10 are not located within the predetermined distance, for example, within 5 meters. Then, the first lock control unit 108*a* performs lock control (Step S208). That is, the first lock control unit 108*a* outputs a lock signal for locking the door to the lock mechanism of the car 2. As such, the radio wave condition determination unit 106*a* determines the ratio of the number of matching devices between the devices RE detected by the first measurement unit 102*a* and the devices RE detected by the electronic key 10 to the total quantity number of the devices RE detected by the first measurement unit 102*a* is equal to or greater than a predetermined value, for example, two thirds or more. If the ratio is equal to or greater than the predetermined value, the first lock control unit 108*a* outputs the unlock signal for unlocking the door to the lock mechanism of the car 2, and if the ratio is less than the predetermined value, the first lock control unit 108*a* outputs the lock signal for locking the door to the lock mechanism of the car 2.

As such, according to the present embodiment, the first lock control unit 108*a* controls whether to lock or unlock the door according to the similarity between the radio wave condition measured by the first measurement unit 102*a* and the radio wave condition transmitted from the electronic key 10*b*. With this, if the distance between the in-vehicle device 10*a* and the electronic key 10*b* is shortened so that the similarity of the radio wave condition becomes higher than the predetermined value, it is possible to unlock the door. On the other hand, if the distance between the in-vehicle device 10*a* and the electronic key 10*b* is lengthened so that the similarity of the radio wave condition becomes lower than the predetermined value, it is possible to lock the door. As such, since it is controlled whether to lock or unlock the door according to the similarity in the radio wave condition between the in-vehicle device 10*a* and the electronic key 10*b*, it is possible to control locking or unlocking of the door in accordance with the distance between the in-vehicle device 10*a* and the electronic key 10*b*.

Modification Example

A modification example is different from an embodiment in that the radio wave condition determination unit 106*a* and the first lock control unit 108*a* are provided on the electronic key 10*b* side.

Figure 8:
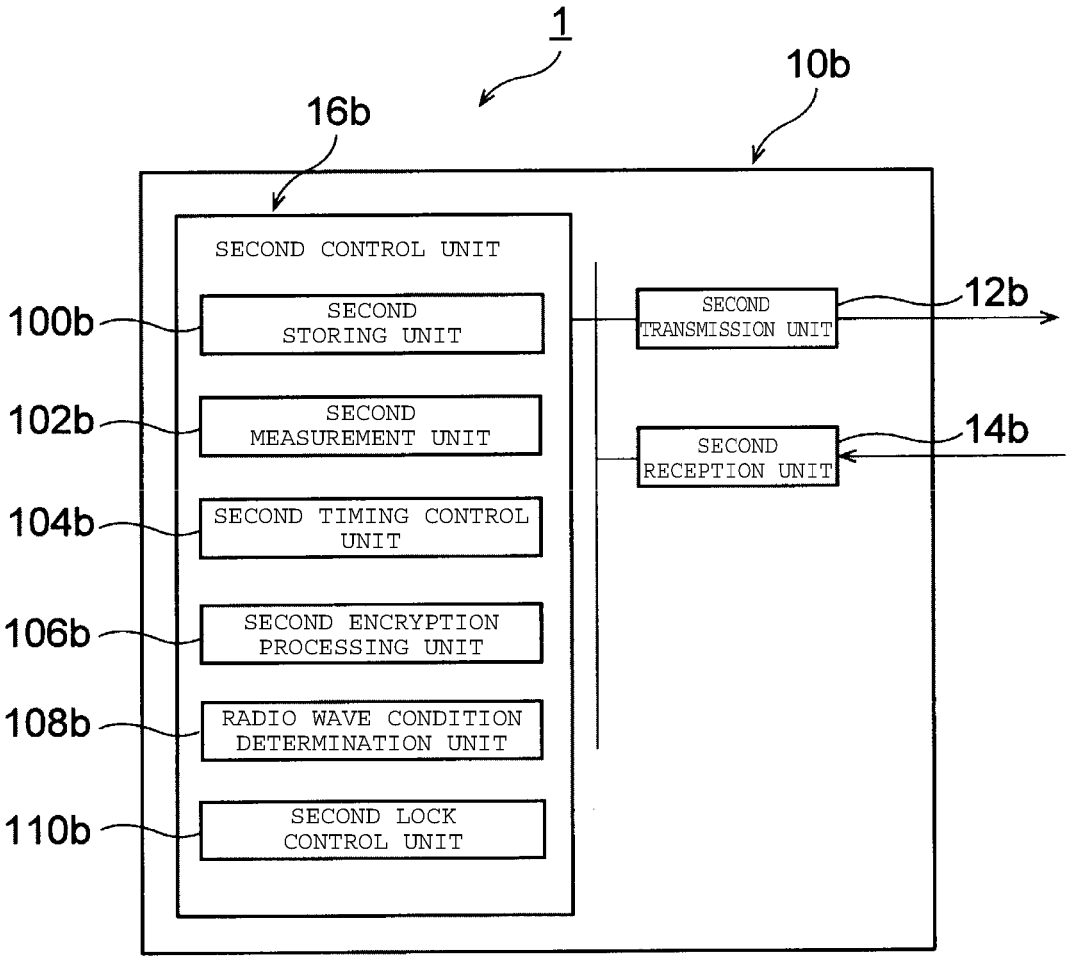
FIG. 8 is a block diagram illustrating a configuration of an electronic key according to a modification example.

FIG. 8 is a block diagram illustrating a configuration of an electronic key 10*b* according to a modification example of the embodiment. As illustrated in FIG. 8, the electronic key 10*b* is different from the embodiment in that the electronic key 10*b* further includes a radio wave condition determination unit 108*b* and a second lock control unit 110*b*.

The radio wave condition determination unit 108*b* has the same configuration as the radio wave condition determination unit 106*a*. That is, the radio wave condition determination unit 108*b* compares the radio wave condition measured by the second measurement unit 102*b* with the radio wave condition transmitted from the in-vehicle device 10*a* and determines whether or not the similarity is high.

The second lock control unit 110*b* has the same configuration as the first lock control unit 108*a*. That is, the second lock control unit 110*b* controls whether to lock or unlock the door according to the similarity between the radio wave condition measured by the second measurement unit 102*b* and the radio wave condition transmitted from the in-vehicle device 10*a*. The in-vehicle device 10*a* according to the modification example of the embodiment corresponds to the second device, and the electronic key 10*b* according to the modification example of the embodiment corresponds to the first device. Further, the electronic key 10*b* according to the modification example of the embodiment corresponds to the door lock apparatus.

As described above, according to a modification example of the embodiment, the radio wave condition determination unit 108*b* of the electronic key 10*b* determines the similarity between the radio wave condition measured by the second measurement unit 102*b* and the radio wave condition transmitted from the in-vehicle device 10*a*, and the second lock control unit 110*b* outputs the unlock signal in a case where the similarity is high. With this, it is possible to control whether to lock or unlock the door according to asimilarity between radio wave conditions on the electronic key 10*b* side.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A door lock control system comprising:

a first device comprising:

a first transmitter;

a first receiver; and a first controller configured to:

measure first signal strengths of radio signals received from a plurality of surrounding devices by the first receiver; and control the first transmitter to transmit the measured first signal strengths to a second device; and the second device comprising:

a second receiver;

a second transmitter; and a second controller configured to:

measure second signal strengths of radio signals received from a plurality of surrounding devices by the second receiver;

upon receipt of the first signal strengths from the first device, compare the first signal strengths with the second signal strengths; and control a door lock based on the comparison of the first and the second signal strengths, wherein the second controller is further configured to control the second transmitter to transmit to the first device a signal for synchronizing the timing of measuring the first signal strengths and the timing of measuring the second signal strengths, and the first and second controllers are further configured to respectively measure the first and the second signal strengths according to the signal so as to carry out concurrent measurement of the first and the second signal strengths.

2. The door lock control system according to claim 1, wherein the second controller is configured to determine a degree of similarity of the first and the second signal strengths, and control the door lock based on the determined degree of similarity.

3. The door lock control system according to claim 2, wherein the first and the second controllers are configured to measure the first and the second signal strengths a plurality of times, and the second controller unlocks a door when the degree of similarity of the first and the second signal strengths is equal to or greater than a threshold for each measurement.

4. The door lock control system according to claim 3, wherein the second controller determines the degree of similarity based on a number of surrounding devices transmitting the radio signals, the signal strengths of which are equal to or greater than a threshold when received by both the first and the second receivers.

5. The door lock control system according to claim 1, wherein the second controller is configured to encrypt a first authentication code, and control the second transmitter to transmit the encrypted first authentication code to the first device.

6. The door lock control system according to claim 5, wherein the first controller further comprises a first memory that stores the first authentication code, and the first controller is configured to:

decrypt the encrypted first authentication code received from the second device;

compare the decrypted first authentication code with the first authentication code stored in the first memory;

encrypt a second authentication code when the decrypted first authentication code and the stored first authentication code are identical; and control the first transmitter to transmit the encrypted second authentication code to the second device.

7. The door lock control system according to claim 6, wherein the second controller further comprises a second memory that stores the second authentication code, and the second controller is configured to:

decrypt the encrypted second authentication code received from the first device;

compare the decrypted second authentication code with the second authentication code stored in the second memory; and generate the signal for synchronizing the timing of measuring the first signal strengths and the timing of measuring the second signal strengths when the decrypted second authentication code and the stored second authentication code are identical.

8. The door lock control system according to claim 7, wherein the second controller is configured to generate the signal indicating a time to start measuring the first and the second signal strengths.

9. The door lock control system according to claim 1, wherein the first device is an electronic key, and the second device is a device installed in a car or a mailbox.

10. A method carried out in a door lock control system with a first and a second device, the method comprising:

transmitting from the second device to the first device a synchronization signal;

measuring in the first device first signal strengths of radio signals received from a plurality of surrounding devices by the first device, according to the synchronization signal;

measuring in the second device second signal strengths of radio signals received from a plurality of surrounding devices by the second device, according to the synchronization signal;

transmitting the measured first signal strengths from the first device to the second device;

comparing in the second device the first signal strengths with the second signal strengths; and controlling a door lock based on the comparison of the first and the second signal strengths.

11. The method according to claim 10, further comprising:

determining in the second device a degree of similarity of the first and the second signal strengths, wherein the door lock is controlled based on the determined degree of similarity.

12. The method according to claim 11, wherein the first and the second signal strengths are measured a plurality of times, and a door is unlocked when the degree of similarity of the first and the second signal strengths is equal to or greater than a threshold for each measurement.

13. The method according to claim 12, wherein said determining comprises determining the degree of similarity based on a number of surrounding devices transmitting the radio signals, the signal strengths of which are equal to or greater than a threshold when received by both the first and the second devices.

14. The method according to claim 10, further comprising:

encrypting in the second device a first authentication code, and transmitting the encrypted first authentication code from the second device to the first device.

15. The method according to claim 14, further comprising:

decrypting in the first device the encrypted first authentication code received from the second device;

comparing the decrypted first authentication code with the first authentication code stored in the first device in advance;

encrypting a second authentication code when the decrypted first authentication code and the stored first authentication code are identical; and transmitting the encrypted second authentication code from the first device to the second device.

16. The method according to claim 15, further comprising:

decrypting in the second device the encrypted second authentication code received from the first device;

comparing the decrypted second authentication code with the second authentication code stored in the second device in advance; and generating in the second device the signal for synchronizing the timing of measuring the first signal strengths and the timing of measuring the second signal strengths when the decrypted second authentication code and the stored second authentication code are identical.

17. The method according to claim 16, wherein the generated signal indicates a time to start measuring the first and the second signal strengths.

18. A door lock device comprising:

a receiver; and a controller configured to:

transmit to a remote device a signal for synchronizing a timing of measuring second signal strengths of radio signals received by the remote device from a plurality of surrounding devices;

measure first signal strengths of radio signals received from the plurality of surrounding devices by the receiver, according to the signal so that the first signal strengths are measured concurrently with the second signal strengths;

upon receipt of the second signal strengths from the remote device, compare the first signal strengths with the second signal strengths; and control a door lock based on the comparison of the first and second signal strengths.

* * * * *